US005582508A

United States Patent [19]

Chou

[11] Patent Number: 5,582,508

[45] Date of Patent: Dec. 10, 1996

[54] AUTO-CONTROL DEVICE FOR LIFT PUMPS

[76] Inventor: Fu-Hsiung Chou, 5F., No. 9, Lane 408, Ming Hsu Rd., Lu Chou Hsiang, Taipei Hsien, Taiwan

[21] Appl. No.: 438,370

[22] Filed: May 10, 1995

[51] Int. Cl.[6] ..... F04B 49/10

[52] U.S. Cl. ..... 417/32; 374/208

[58] Field of Search ..... 417/32; 307/117; 374/141, 208

[56] References Cited

U.S. PATENT DOCUMENTS

| | | | |
|---|---|---|---|
| 3,751,305 | 8/1973 | Huebscher | 374/208 |
| 4,257,745 | 3/1981 | Thur et al. | 417/32 |
| 4,842,419 | 6/1989 | Nieters | 374/208 |
| 5,145,322 | 9/1992 | Senior, Jr. et al. | 417/32 |
| 5,324,114 | 6/1994 | Vinci | 374/208 |

FOREIGN PATENT DOCUMENTS

| | | | |
|---|---|---|---|
| 58-117427 | 7/1983 | Japan | 374/206 |
| 2178796 | 2/1987 | United Kingdom . | |

*Primary Examiner*—Timothy Thorpe
*Assistant Examiner*—Xuan M. Thai
*Attorney, Agent, or Firm*—Varndell Legal Group

[57] ABSTRACT

An auto-control device including a housing mounted on a lift pump, a sensor mounted within the housing by a locating block to detect the temperature of the lift pump, a spring member fastened to the housing on the inside to give a downward pressure to the sensor, a two-line electric wire having one end welded to two contact legs on the sensor and an opposite end extended out of a wire hole on the housing and connected to the power supply circuit of the lift pump, and epoxy resin filled through the wire hole into the inside of the housing, wherein the sensor automatically cuts off power supply from the lift pump when the temperature of the lift pump surpasses a predetermined high temperature level, or turns on the lift pump when the temperature of the lift pump drops below a predetermined low temperature level.

1 Claim, 3 Drawing Sheets

AUTO-CONTROL DEVICE FOR LIFT PUMPS

BACKGROUND AND SUMMARY OF THE INVENTION

The present invention relates to an auto-control device for controlling the operation of a lift pump subject ot the detection result of a temperature sensor, which automatically detects the temperature of the lift pump.

When a lift pump is operated, a circuit breaker is commonly installed in the coil of the motor of the lift pump to automatically cut off power supply when the coil is overloaded. The maximum load of the coil of the motor is generally set at 75° C. , that is when the temperature of the coil of the motor reaches 75° C. , the circuit breaker automatically cuts off power supply from the circuit. The rising of the temperature of the coil of the motor to as high as 75° C. generally occurs a certain length of time after an idle running of the lift pump. If power supply is not cut off from the lift pump when the lift pump is overloaded due to an idle running, the lift pump will be burnt out. However, even if a circuit breaker is installed, the vanes of the lift pump will wear away quickly when the lift pump frequently runs idle. When the vanes of the lift pump begin to wear, the lift pump will consume much electric current to provide the same amount of water lifting power. In consequence, a longer length of time is needed to trigger the circuit breaker when the lift pump is overloaded. There is also known a water-pressure controlled auto-control device for use with a lift pump. This structure of water pressure switch, which can be triggered to automatically turn on the motor of the pump by water pressure. However, if the water tap of the water tank is opened when the water level of the water tank drops below the drain port of the pump or the water tank is empty, the pump will run idle, and the pressure switch can not be reset to automatically turned off the pump after the water tap is closed. When this situation happens, the pump will be burnt out.

The present invent on has been accomplished under the circumstances in view. It is one object of the present invention to provide a lift pump auto-control device which eliminates the aforesaid problems. It is another object of the present invention to provide a lift pump auto-control device which automatically turns off the lift pump when the temperature of the lift pump surpasses a predetermined high temperature level, and which automatically turns off the lift pump when the temperature of the lift pump drops below a predetermined low temperature level. It is still another object of the present invention to provide a lift pump auto-control device which is easy to install. It is still another object of the present invention to provide a lift pump auto-control device which needs little installation space.

According to one aspect of the present invention, the lift pump auto-control device comprises a housing fastened to the outside wall of the lift pump by a double-sided annular adhesive tape, and a sensor mounted inside the housing by a locating block to detect the temperature of the lift pump. According to another aspect of the present invention, the sensor automaticlly cuts off power supply from the lift pump when the temperature of the lift pump surpasses 50° C., and automatically turns on the lift pump when the temerpature of the lift pump drops below 28° C. According to still another aspect of the present invention, a spring member is mounted inside the housing to give a downward pressure to the sensor, so that the temperature detecting side is of the sensor is maintained closely in contact with the outside wall of the lift pump. According to still another aspect of the present invention, a heat-insulative ring is mounted within the housing around the sensor so that the sensor effectively detects the temperature of the lift pump. According to still another aspect of the present invention, epoxy resin is filled from the wire hole on the housing into the inside of the housing to bond the internal parts of the lift pump auto-control device firmly together and simultaneously to seal off water.

DETAILED DESCRIPTION OF THE PREFERRED EMBODIMENT

Figure 1:
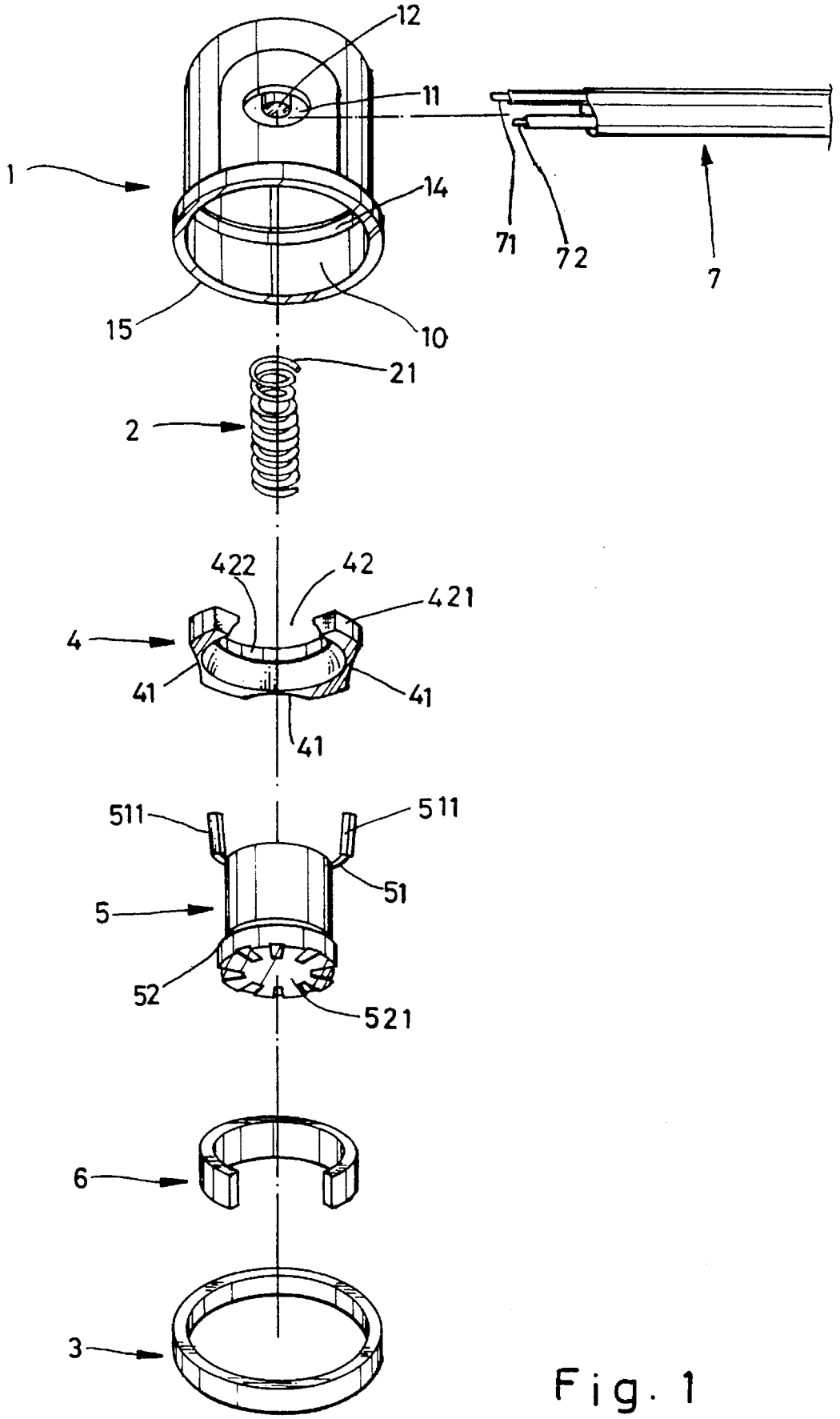
FIG. 1 is an exploded view of an auto-control device for lift pump according to the present invention.
Figure 2:
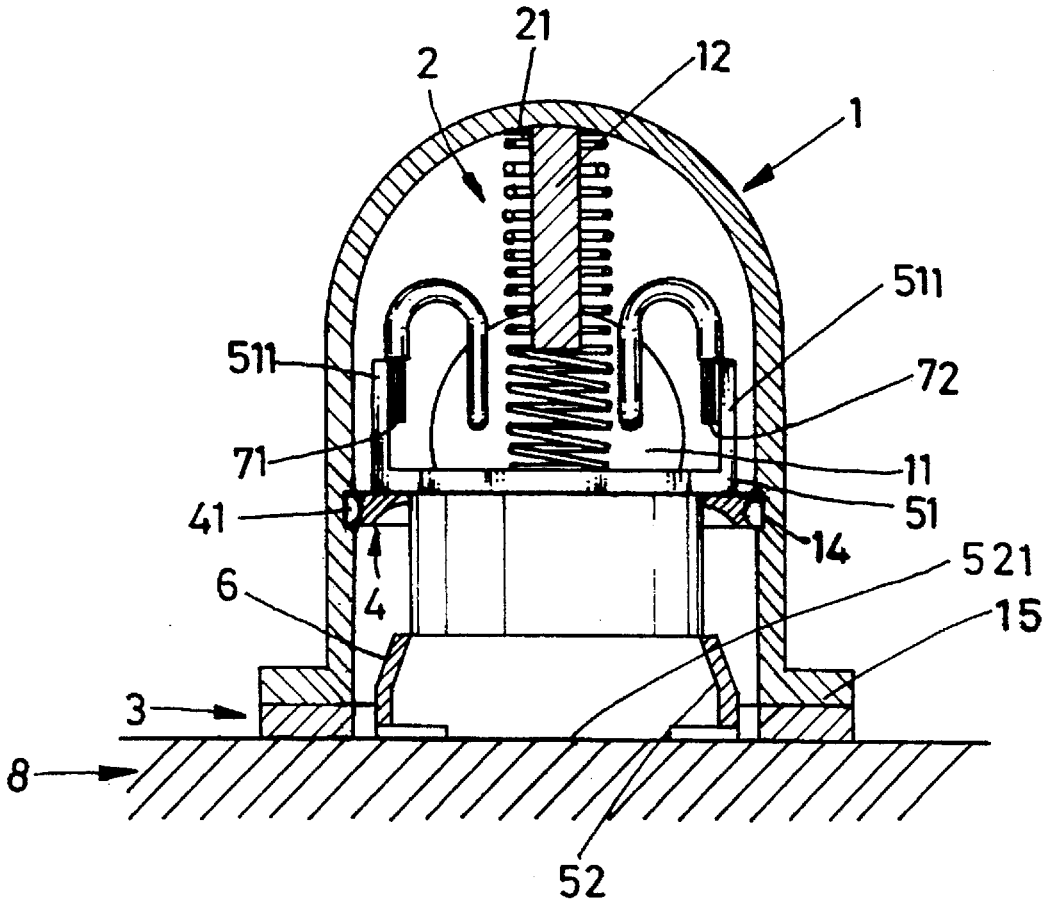
FIG. 2 is sectional view showing the auto-control device of FIG. 1 installed in a lift pump.
Figure 3:
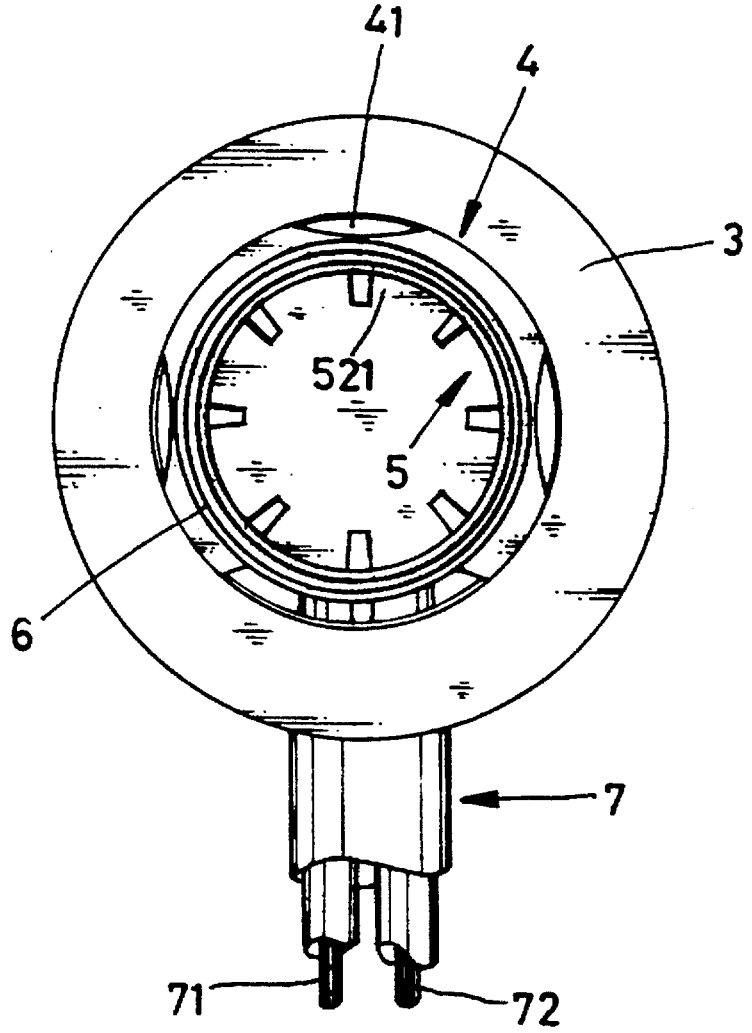
FIG. 3 is a bottom view in an enlarged scale of the auto-control device according to the present invention.

Referring to FIGS. 1, 2, and 3, an auto-control device for lift pumps in accordance with the present invention is generally comprised of a housing 1, a spring member 2, a locating block 4, a sensor 5, a heat-insulative ring 6, and a double-sided annular adhesive tape 3.

The housing 1 comprises a bottom chamber 10, a wire hole 11 through the periphery at a suitable location, through which an electric wire 7 is inserted from the inside to the outside and then connected to the power supply circuit of the lift pump 8, a retainer rod 12 at the center of the inside top wall thereof to hold one end 21 of the spring member 2, an inside annular groove 14 around the border of the bottom chamber 10 near the bottom end, and an annular bottom edge 15 around the bottom chamber 10 at the bottom. The annular bottom edge 15 is fastened to the outside wall of the lift pump, referenced by 8, by the double-sided annular adhesive tape 3 (see FIG. 2).

The locating block 4 comprises an outward top flange 421 fitted into the inside annular groove 14 on the housing 1, a center through hole 42, an inward top flange 422 around the center through hole 42 for mounting the sensor 5, and a plurality of side grooves 41.

The sensor 5 detects the temperature of the lift pump 8 and automatically cuts off power supply from the lift pump 8 when the detected temperature surpasses a predetermined value, having a contact plate 51 at the top side thereof. The sensor 5 is inserted through the center through hole 42 on the locating block 4, permitting the legs 511 of the contact plate 51 to be stopped above the inward top flange 422 of the locating block 4. The contact plate 51 has two legs 511 extended out of the locating block 4 and respectively welded to the two opposite terminals 71 and 72 of the electric wire 7. The heat-insulative ring 6 is mounted around the bottom end 52 of the sensor 5. The bottom side 521 of the sensor 5 is covered with a layer of a silicone rubber.

The asssembly process of the auto-control device is outlined hereinafter. The two opposite terminals 71 and 72 of the electric wire 7 are respectively welded to the legs 511 of the contact plate 51 of the sensor 5, then the heat-insulative ring 6 is mounted around the sensor 5, then the sensor 5 is fastened to the locating block 4, then the top end 21 of the spring member 2 is mounted around the retainer rod 12 of the housing, then the electric wire 7 is extended out of the housing 1 through the wire hole 11, permitting the sensor 5 and the locating block 4 to be inserted into the bottom chamber 10 of the housing 1, then the bottom side (the temperature detecting side) 521 of the sensor 5 is coated with a layer of a silicone rubber, and then the double-sided annular adhesive tape 3 is adhered to the annular bottom edge 15 of the housing 1. When the auto-control device 1 is bonded to the lift pump 8 by the double-sided annular adhesive tape 3, epoxy resin is filled into the wire hole 11 to seal the gap. Because the locating block 4 has side grooves 41, epoxy resin can pass through the gaps between the inside wall of the housing 1 and the peripheral wall of the locating block 4 to fill up the spaced within the housing 1 around the sensor 5 below the locating block 4. When the auto-control device is installed in the lift pump 8, the operation of the lift pump 8 is automatically controlled by the auto-control device, that is, when the temperature of the lift pump 8 surpasses a predetermined value, for example, 50° C., the auto-control device automatically cuts off power supply; when the temperature of the lift pump 8 drops below a predetermined value, for example 28° C., the auto-control device automatically turns on the lift pump 8.

I claim:

1. An auto-control device comprising:

a housing fastened to the outside wall of a lift pump by bonding means, said housing comprising a wire hole through the periphery, a retainer rod at a center of an inside top wall thereof, and an inside annular groove;

a locating block fitted into said inside annular groove within said housing, said locating block comprising a center through hole, and a plurality of side grooves through the periphery for allowing epoxy resin to be filled from a space within said housing above said locating block into the space within said housing below said locating block;

a sensor inserted through the center through hole on said locating block, having two contact legs disposed above the elevation of said locating block and a temperature detecting side covered with a layer of a silicone rubber and attached to the outside wall of of said lift pump;

a heat-insulative ring mounted around said sensor within said housing;

a spring member having a top end fastened to a retainer rod of said housing and a bottom end stopped against said sensor;

a two-line electric wire having one end inserted through the wire hole on said housing and welded to the two contact legs of said sensor and an opposite end extended out of said housing and connected to a power supply circuit of said lift pump; and epoxy resin filled from said wire hole into the inside of said housing;

wherein, when the temperature of said lift pump surpasses a predetermined high temperature level, said sensor automatically cuts off power supply from said lift pump; when the temperature of said lift pump drops below a predetermined low temperature level, said sensor automatically turns on said lift pump.

* * * * *